US011623259B2

(12) United States Patent
Ma et al.

(10) Patent No.: US 11,623,259 B2
(45) Date of Patent: Apr. 11, 2023

(54) SYSTEM FOR FLATTENING STEEL PLATES

(71) Applicant: Taiyuan University of Science and Technology, Taiyuan (CN)

(72) Inventors: Lifeng Ma, Taiyuan (CN); Rongjun Wang, Taiyuan (CN); Zhibin Yao, Taiyuan (CN); Lianyun Jiang, Taiyuan (CN); Lidong Ma, Taiyuan (CN); Wenxu Yuan, Taiyuan (CN); Hailian Gui, Taiyuan (CN); Yuquan Tong, Taiyuan (CN)

(73) Assignee: TAIYUAN UNIVERSITY OF SCIENCE AND TECHNOLOGY, Taiyuan (CN)

( * ) Notice: Subject to any disclaimer, the term of this patent is extended or adjusted under 35 U.S.C. 154(b) by 154 days.

(21) Appl. No.: 17/153,929

(22) Filed: Jan. 21, 2021

(65) Prior Publication Data

US 2021/0220888 A1 Jul. 22, 2021

(30) Foreign Application Priority Data

Jan. 21, 2020 (CN) ..... 202010068981.9

(51) Int. Cl.
*B21D 1/02* (2006.01)
*B21D 43/08* (2006.01)
(Continued)

(52) U.S. Cl.
CPC ..... *B21D 1/02* (2013.01); *B21D 43/08* (2013.01); *B21D 1/06* (2013.01); *B21D 43/003* (2013.01); *B21D 43/04* (2013.01); *B21D 43/20* (2013.01)

(58) Field of Classification Search
CPC ..... B21D 1/00; B21D 1/06; B21D 43/003; B21D 43/04; B21D 43/08; B21D 43/20; B21D 43/26
See application file for complete search history.

(56) References Cited

U.S. PATENT DOCUMENTS 3,916,742 A * 11/1975 Biernot ..... B26D 7/16 83/27
2008/0134740 A1* 6/2008 Xu ..... B21D 43/025 72/17.3
2015/0146218 A1* 5/2015 Kerscher ..... G01V 8/10 356/625

FOREIGN PATENT DOCUMENTS

CN 103486995 A * 1/2014 ..... G01B 21/20
CN 106955908 A * 7/2017 ..... B21C 51/00
(Continued)

*Primary Examiner* — Debra M Sullivan
*Assistant Examiner* — Matthew Stephens
(74) *Attorney, Agent, or Firm* — Matthias Scholl P.C.; Matthias Scholl

(57) ABSTRACT

A system for flattening steel plates includes crane, a first conveyor, a second conveyor, a first shape detector, a second shape detector, a first rangefinder, a second rangefinder, a first detection device, a second detection device, a first idler roller, a second idler roller, a flattening machine, a first robot, a second robot, a third robot, and a fourth robot. The flattening machine is connected to one end of the first conveyor and one end of the second conveyor. The first shape detector is disposed above a middle part of the first conveyor. The second shape detector is disposed above a middle part of the second conveyor. The first rangefinder is disposed at one end of the first conveyor. The first detection device is disposed between the first rangefinder and the flattening machine. The second rangefinder is disposed on one end of the flattening machine.

2 Claims, 15 Drawing Sheets

(51) Int. Cl.

| | |
|---|---|
| ***B21D 1/06*** | (2006.01) |
| ***B21D 43/00*** | (2006.01) |
| ***B21D 43/20*** | (2006.01) |
| ***B21D 43/04*** | (2006.01) |

(56) References Cited

FOREIGN PATENT DOCUMENTS

| | | | | | |
|---|---|---|---|---|---|
| CN | 107020310 | A | * | 8/2017 | ..... B21C 51/00 |
| KR | 101421930 | B1 | * | 7/2014 | ..... B21D 13/04 |
| KR | 20140108753 | A | * | 9/2014 | ..... B21D 3/05 |

* cited by examiner

SYSTEM FOR FLATTENING STEEL PLATES

CROSS-REFERENCE TO RELATED APPLICATIONS

Pursuant to 35 U.S.C. § 119 and the Paris Convention Treaty, this application claims foreign priority to Chinese Patent Application No. 202010068981.9 filed Jan. 21, 2020, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to a system for flattening steel plates.

Steel plates may deform during the cooling and transportation process and need to be flattened. In general, a straightening machine has a limited capacity in flattening materials with various sizes. For example, conventional straightening machine can thermally treat steel plates having a thickness of less than 100 mm and cold treat steel plates having a thickness of less than 40 mm.

In recent years, roller levelers have been used for flattening steel plates with thickness of more than 100 mm. For flattening, at least two backing plates are disposed on two sides of the steel plates, respectively. After the process is completed, the backing plates tend to adhere to the steel plates, and it is laborsome to remove the backing plates. The flatness of the steel plates is judged by experience, which is unreliable.

SUMMARY

The disclosure provides a system for flattening steel plates.

Referring to FIGS. 1 and 2, the system for flattening steel plates comprises a crane 1 for loading and unloading steel plates, a first conveyor 2, a second conveyor 2', a first shape detector 3, a second shape detector 3', a first rangefinder 4, a second rangefinder 4', a first detection device 5, a second detection device 5', a first idler roller 6, a second idler roller 6', a flattening machine 7, a first robot 8', a second robot 8", a third robot 9', and a fourth robot 9". The flattening machine 7 is connected to one end of the first conveyor 2 and one end of the second conveyor 2'. The first conveyor 2 and the second conveyor 2' each have a total length more than twice the length L of a steel plate II. The first shape detector 3 is disposed above a middle part of the first conveyor 2. The second shape detector 3' is disposed above a middle part of the second conveyor 2'. The first rangefinder 4 is disposed at one end of the first conveyor 2. The first detection device 5 is disposed between the first rangefinder 4 and the flattening machine 7. The second rangefinder 4' is disposed on one end of the flattening machine 7. The second detection device 5' is disposed between the second rangefinder 4' and the flattening machine 7. The flattening machine 7 comprises an inlet, an outlet, a flattening table 7.1, and a rack enclosure 7.4. The first idler roller 6 and the second idler roller 6' are respectively disposed on the inlet and the outlet. The first robot 8' and the second robot 8" are respectively disposed on the inlet and outlet. The third robot 9' and the fourth robot 9" are respectively disposed on both ends of the flattening table 7.1. A line between the first robot 8' and the second robot 8" is perpendicular to that between the third robot 9' and the fourth robot 9". The first robot 8' and the second robot 8" are configured to place or retract a first backing plate I'. The third robot 9' and the fourth robot 9" are configured to place or retract a second backing plate I". The crane 1 is disposed above the first conveyor 2 and the second conveyor 2'.

Referring to FIGS. 3A-3B, the first rangefinder 4 has the same structure as the second rangefinder 4'. The first rangefinder 4 comprises a first roller 4.1, a first encoder 4.2, a first lifting cylinder 4.3, and a first guiding device 4.4. The second rangefinder 4' comprises a second roller 4.1', a second encoder 4.2', a second lifting cylinder 4.3', and a second guiding device 4.4'.

Referring to FIGS. 4A-4B, the flattening machine further comprises an indenter 7.2, a pneumatic cylinder 7.3, and a trolley 7.5.

The third robot 9' has the same structure as the fourth robot 9". Referring to FIG. 6, the third robot 9' comprises a base assembly 9.1, a traverse device 9.2, a pushing device 9.3, a swing device 9.4, and an electromagnet 9.5.

Referring to FIG. 7 the base assembly 9.1 comprises a base plate 9.1.1 comprising two protrusions, a first guide rail 9.1.2, a second guide rail 9.1.2', a gear rack 9.1.3 comprising teeth, and a plurality of rail clips 9.1.4. The first guide rail 9.1.2 and the second guide rail 9.1.2' are respectively disposed on the two protrusions, and are secured and supported by the plurality of rail clips. The gear rack 9.1.3 is disposed adjacent and parallel to the first guide rail 9.1.2 or the second guide rail 9.1.2'.

Referring to FIGS. 8A-8B and 9, the traverse device 9.2 comprises a first base 9.2.1, a first sliding block 9.2.2, a second sliding block 9.2.2', a mounting hole 9.2.3, a first gear motor 9.2.4, a second base 9.2.5, a gear shaft 9.2.6, a bearing 9.2.7, a spacer ring 9.2.8, and a first shaft sleeve 9.2.9. The first sliding block 9.2.2 and the second sliding block 9.2.2' are respectively disposed under the both sides of the first base 9.2.1. The first gear motor 9.2.4 is connected to the second base 9.2.5. The second base 9.2.5 is connected to the gear shaft 9.2.6 and disposed in the mounting hole 9.2.3. The bearing 9.2.7 and the spacer ring 9.2.8 are disposed on the gear shaft 9.2.6. The gear shaft 9.2.6 is inserted into the mounting hole 9.2.3 and interlocks with the teeth of the gear rack 9.1.3. The first shaft sleeve 9.2.9 is disposed in the second base 9.2.5.

Referring to FIGS. 10A-10B and 11, the pushing device 9.3 comprises a second gear motor 9.3.1, a second shaft sleeve 9.3.2, a shaft 9.3.3, a first bearing seat 9.3.4, a second bearing seat 9.3.4', a first pushing bearing 9.3.5, a second pushing bearing 9.3.5', a first through cover 9.3.6, a second through cover 9.3.7, a third through cover 9.3.7', an end cover 9.3.8, a baffle 9.3.9, and a pushing rack 9.3.10. The shaft 9.3.3 is connected to the first bearing seat 9.3.4 and the second bearing seat 9.3.4' and then is disposed on the first base 9.2.1. The shaft 9.3.3 is connected to the first pushing bearing 9.3.5 and the second pushing bearing 9.3.5' and then is disposed on the first bearing seat 9.3.4 and the second bearing seat 9.3.4'. One end of the shaft 9.3.3 is connected to the second gear motor 9.3.1 and another end of the shaft 9.3.3 is connected to the baffle 9.3.9. The pushing rack 9.3.10 interlocks with the gear in the middle part of the shaft 9.3.3. The second gear motor 9.3.1 and the first pushing bearing 9.3.5 are respectively connected to both ends of the second shaft sleeve 9.3.2. The first bearing seat 9.3.4 and the second bearing seat 9.3.4' are respectively disposed on the first base 9.2.1. The first through cover 9.3.6 and the second through cover 9.3.7 are respectively disposed on both ends of the first bearing seat 9.3.4. The third through cover 9.3.7' and the end cover 9.3.8 are respectively connected to both ends of the second bearing seat 9.3.4'.

Referring to FIGS. 12 and 13, the swing device 9.4 comprises a third gear motor 9.4.1, a bearing base 9.4.2, a nut 9.4.3, a third shaft sleeve 9.4.4, a first swing bearing 9.4.5, a second swing bearing 9.4.5', a third base 9.4.6, a rotating shaft 9.4.7, a fourth shaft sleeve 9.4.8, a fifth shaft sleeve 9.4.9, a fourth through cover 9.4.10, a bevel gear 9.4.11, a bearing baffle 9.4.12, a third base 9.4.13, a fourth base 9.4.13', a first spacer 9.4.14, a second spacer 9.4.14', and a swing arm 9.4.15. The rotating shaft 9.4.7 is inserted into the fourth shaft sleeve 9.4.8. One end of the rotating shaft 9.4.7 is sequentially inserted into the first swing bearing 9.4.5, the third shaft sleeve 9.4.4, the nut 9.4.3, the bearing base 9.4.2, and the third gear motor 9.4.1. Another end of the rotating shaft 9.4.7 is sequentially inserted into the second swing bearing 9.4.5', the fourth through cover 9.4.10, the fifth shaft sleeve 9.4.9, the bevel gear 9.4.11, and the bearing baffle 9.4.12. The bearing baffle drives the swing arm 9.4.15 to rotate. The third base 9.4.13 and the fourth base 9.4.13' are disposed on the outer surface of the fourth shaft sleeve 9.4.8. The first spacer 9.4.14 is disposed on the third base 9.4.13 and the second spacer 9.4.14' is disposed on the fourth base 9.4.13'. The fourth shaft sleeve 9.4.8 is disposed in the hole of the third base 9.4.6. The pushing rack 9.3.10 is disposed under the fourth shaft sleeve 9.4.8. One end of the swing arm 9.4.15 is disposed in the first spacer 9.4.14 and the second spacer 9.4.14'. The bevel gear of the swing arm 9.4.15 interlocks with that of the bevel gear 9.4.11. Another end of the swing arm 9.4.15 is provided with the electromagnet 9.5.

The following advantages are associated with the system for flattening steel plates of the disclosure. The system for flattening steel plates offers advantages in continuous stability, higher degree of automation, lower labor intensity, higher flattening accuracy and production efficiency over related flattening systems.

Figure 1:
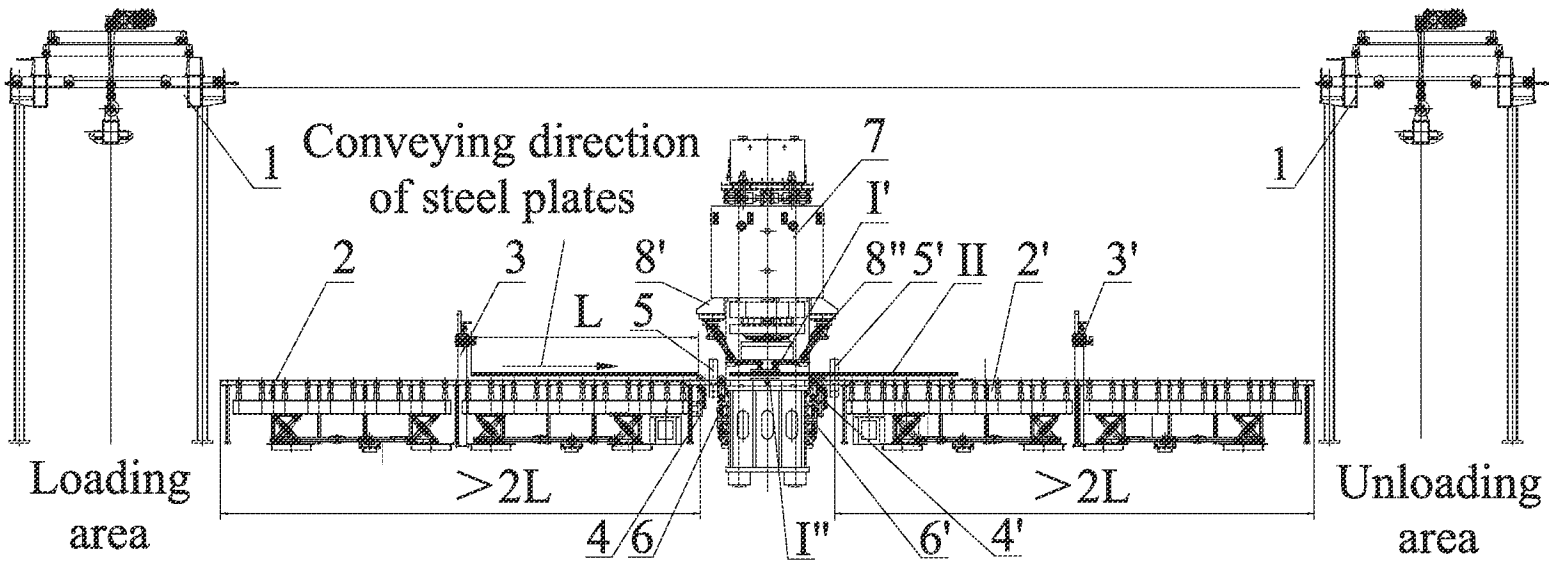
FIG. 1 is a front view of a system for flattening steel plates according to one embodiment of the disclosure.
Figure 2:
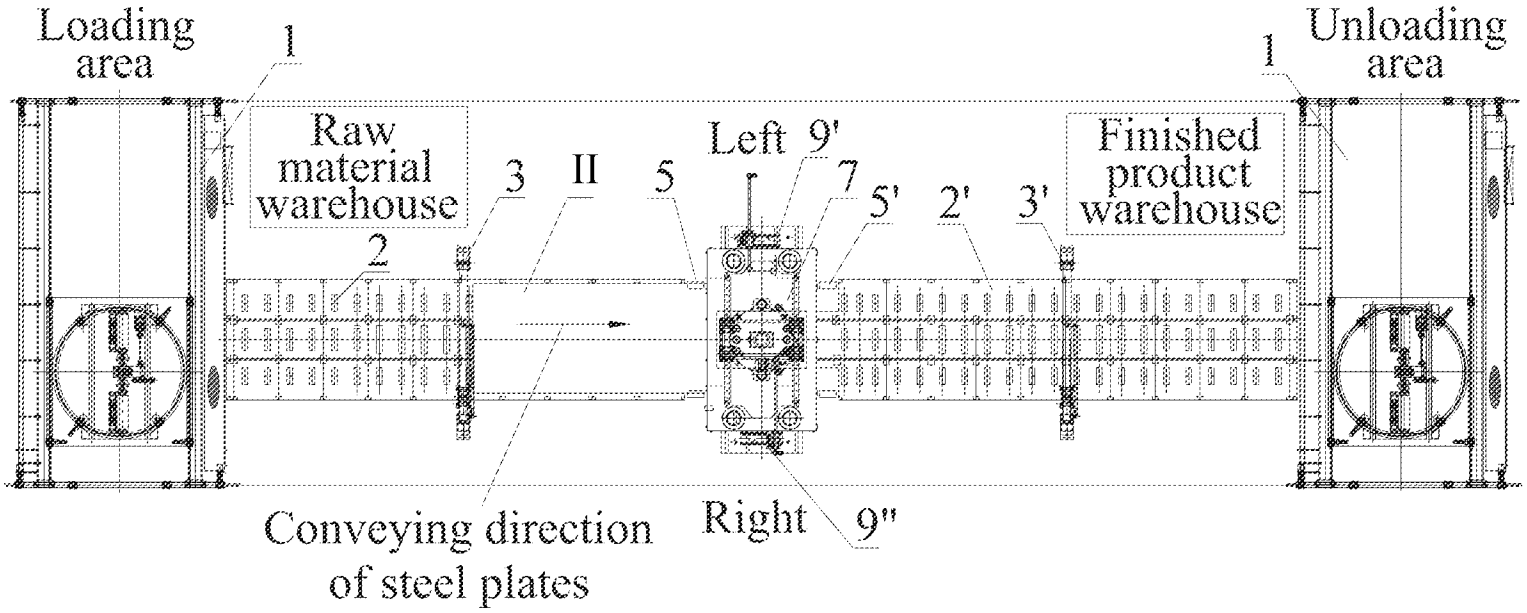
FIG. 2 is a top view of a system for flattening steel plates according to one embodiment of the disclosure.
Figure 3A:
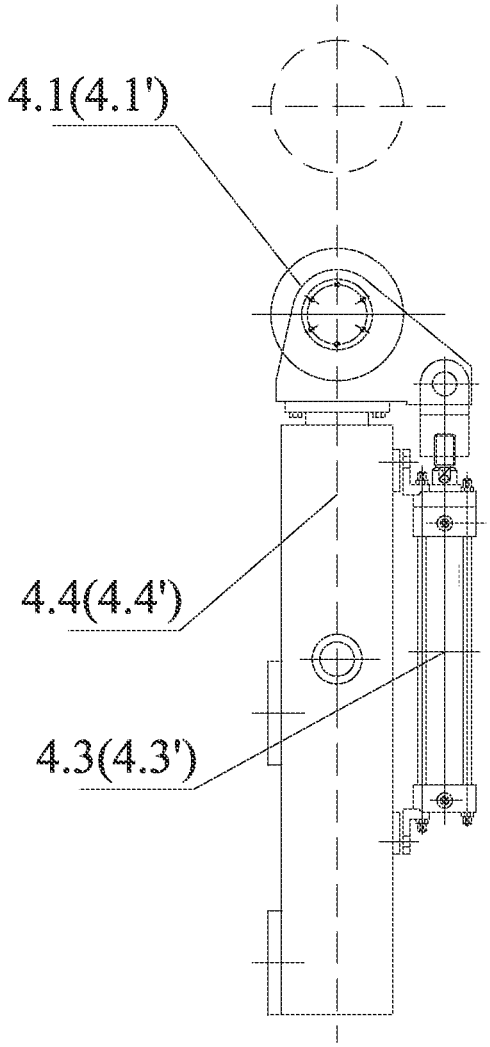
FIG. 3A is a front view of a rangefinder according to one embodiment of the disclosure.
Figure 3B:
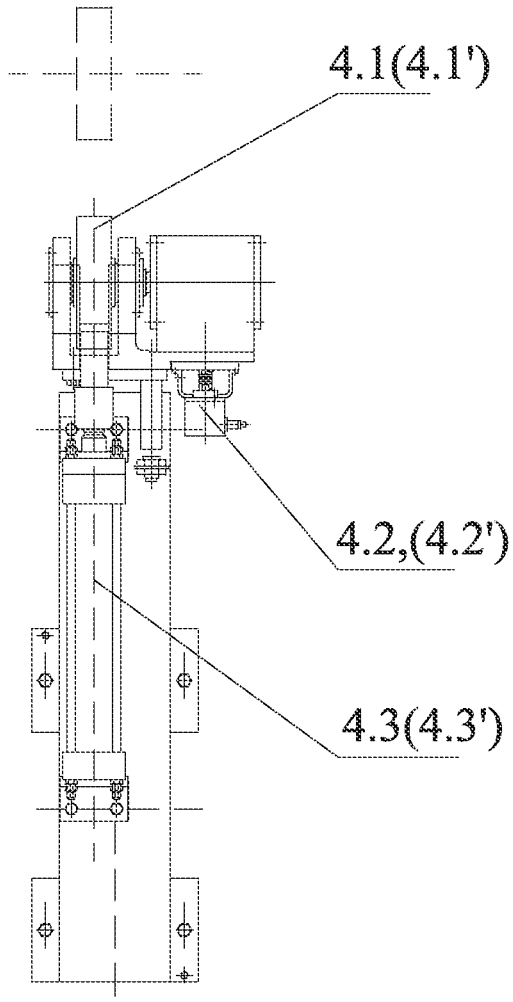
FIG. 3B is a side view of a rangefinder according to one embodiment of the disclosure.
Figure 4A:
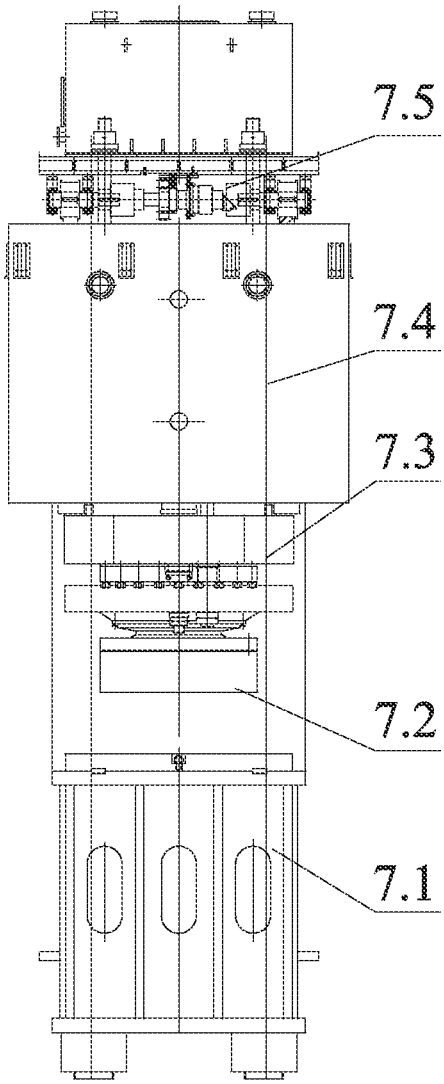
FIG. 4A is a schematic diagram of a flattening machine according to one embodiment of the disclosure.
Figure 4B:
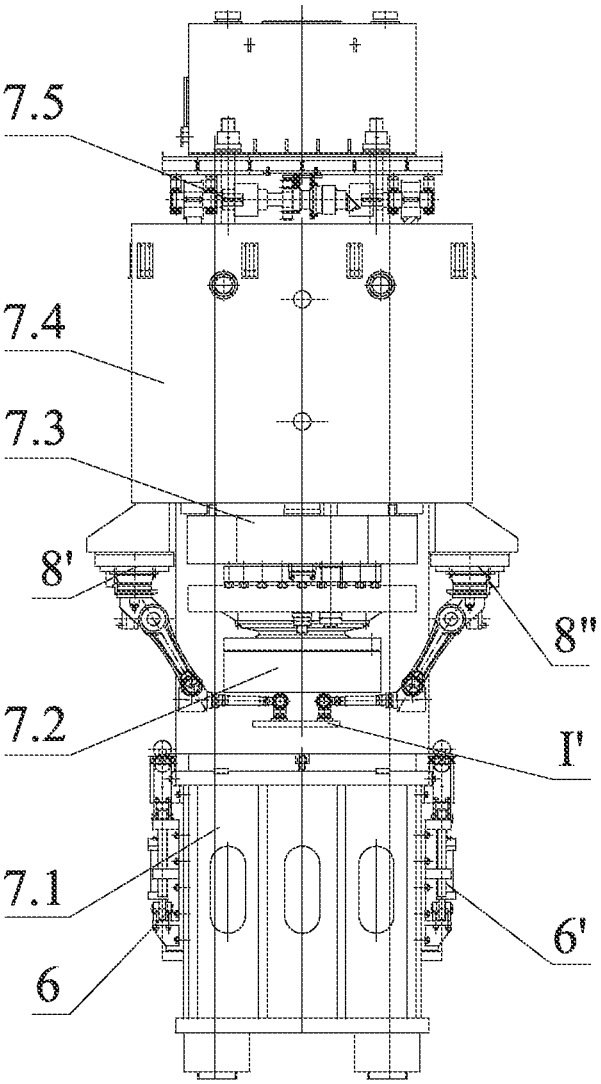
FIG. 4B is a schematic diagram of a flattening machine in another angle of view.

In the drawings, the following reference numbers are used: 1. Crane; 2. First conveyor; 2'. Second conveyor; 3. First shape detector; 3'. Second shape detector; 4. First rangefinder; 4'. Second rangefinder; 5. First detection device; 5'. Second detection device; 6. First idler roller; 6'. Second idler roller; 7. Flattening machine; 8'. First robot; 8". Second robot; 9'. Third robot; 9". Fourth robot; 4.1. First roller; 4.1'. Second roller; 4.2. First encoder; 4.2'. Second encoder; 4.3. First lifting cylinder; 4.3'. Second lifting cylinder; 4.4. First guiding device; 4.4'. Second guiding device; 7.1. Flattening table; 7.2. Indenter; 7.3. Pneumatic cylinder; 7.4. Rack enclosure; 7.5. Trolley; 7.4.1. First column; 7.4.2. Second column; 7.4.1'. Third column; 7.4.2'. Fourth column; 7.5. Trolley; 9.1. Base assembly; 9.2. Traverse device; 9.3. Pushing device; 9.4. Swing device; 9.5. Electromagnet; 9.1.1. Base plate; 9.1.2. First guide rail; 9.1.2'. Second guide rail; 9.1.3. Gear rack; 9.1.4. Rail clip; 9.2.1. First base; 9.2.2. First sliding block; 9.2.2'. Second sliding block; 9.2.3. Mounting hole; 9.2.4. First gear motor; 9.2.5. Second base; 9.2.6. Gear shaft; 9.2.7. Bearing; 9.2.8. Spacer ring; 9.2.9. First shaft sleeve; 9.3.1. Second gear motor; 9.3.2. Second t shaft sleeve; 9.3.3. Shaft; 9.3.4. First bearing seat; 9.3.4'. Second bearing seat; 9.3.5. First pushing bearing; 9.3.5'. Second pushing bearing; 9.3.6. First through cover; 9.3.7. Second through cover; 9.3.7'. Third through cover; 9.3.8. End cover; 9.3.9. Baffle; 9.3.10. Pushing rack; 9.4.1. Third gear motor; 9.4.2. Bearing base; 9.4.3. Nut; 9.4.4. Third shaft sleeve; 9.4.5. First swing bearing; 9.4.5'. Second swing bearing; 9.4.6. Third base; 9.4.7. Rotating shaft; 9.4.8. Fourth shaft sleeve; 9.4.9. Fifth shaft sleeve; 9.4.10. Fourth through cover; 9.4.11. Bevel gear; 9.4.12. Bearing baffle; 9.4.13. Third base; 9.4.13'. Fourth base; 9.4.14. First spacer; 9.4.14'. Second spacer; 9.4.15. Swing arm; 9.5. Electromagnet; I'. First backing plate; I". Second backing plate; and II. Steel plate.

DETAILED DESCRIPTION

To further illustrate the disclosure, embodiments detailing a system for flattening steel plates of the disclosure are described below. It should be noted that the following embodiments are intended to describe and not to limit the disclosure.

A process of flattening a steel plate:

A steel plate II is hoisted by a crane 1 from a raw material warehouse to a first conveyor 2. A first shape detector 3 is configured to detect the shape of the steel plate II when the steel plate II moves toward the flattening machine 7.

A first guiding device 4.4 helps a first roller 4.1 stay on track. When the steel plate II is located directly below the first detection device 5, the first roller 4.1 is lifted up by a first lifting cylinder 4.3 so as to contact with the steel plate II. The conveying distance of the steel plate II is monitored by a first rangefinder 4. A first encoder 4.2 is configured to record the number of revolutions m1. If the radius of the first roller 4.1 is R, then the perimeter of the first roller 4.1 is $2\pi R$, and the conveying distance of the steel plate II is $L=2m1\eta R$.

A first idler roller 6 and a second idler roller 6' are lifted to the highest position before flattening of the steel plate. The steel plate II is then lifted so as to create a gap between the lower surface of the steel plate II and the upper surface of the flattening table 7.1. A first robot 8', a second robot 8", a third robot 9', and a fourth robot 9" are disposed on the flattening machine. The first idler roller 6 and the second idler roller 6' are lowered at the lowest position. A trolley 7.5 is configured to adjust the position of an indenter 7.2. A pneumatic cylinder 7.3 drives the indenter 7.2 to move downwards, flattening the steel plate II.

Then the pneumatic cylinder 7.3 drives the indenter 7.2 to move upwards, allowing the first robot 8' and the second robot 8" to retract a first backing plate I'. The first idler roller 6 and the second idler roller 6' are lifted to the highest position so as to lift the steel plate II, allowing the third robot 9' and the fourth robot 9" to retract a second backing plate I". The first idler roller 6 and the second idler roller 6' are lowered at the lowest position and the steel plate II is transported forward for next flattening.

When the first detection device 5 cannot detect the steel plate II, the first roller 4.1 is lowered at the lowest position by a first lifting cylinder 4.3. When the first encoder 4.2 has gone k revolutions, the steel plate II has a total length of $L=2k\pi R$.

When the second detection device 5' cannot detect the steel plate II, the second roller 4.1' is lowered at the lowest position by a second lifting cylinder 4.3'.

The second shape detector 3' is configured to detect the shape of the flattened steel plate II. When the shape of the steel plate II does not meet the requirements of the finished products, the first conveyor 2 and the second conveyor 2' are configured to transport the steel plate II to the flattened machine in the opposite direction so as to flatten the steel plate II again.

A crane 1 is configured to load or unload the flattened steel plate II to a finished product warehouse.

A process of placing the second backing plate I" using the third robot 9' and the fourth robot 9".

Figure 5:
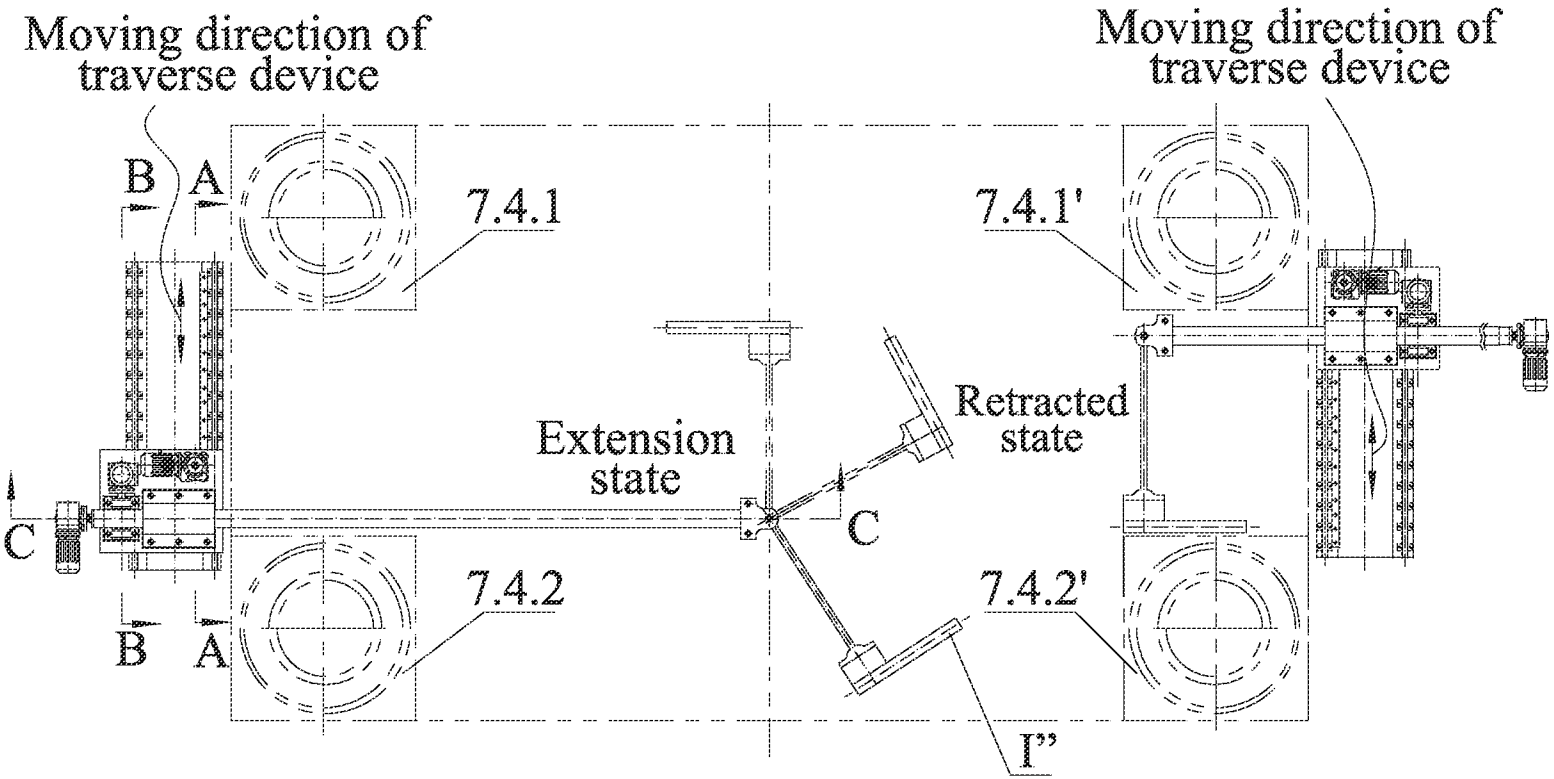
FIG. 5 is a schematic diagram of a working area of a system for flattening steel plates.
Figure 6:
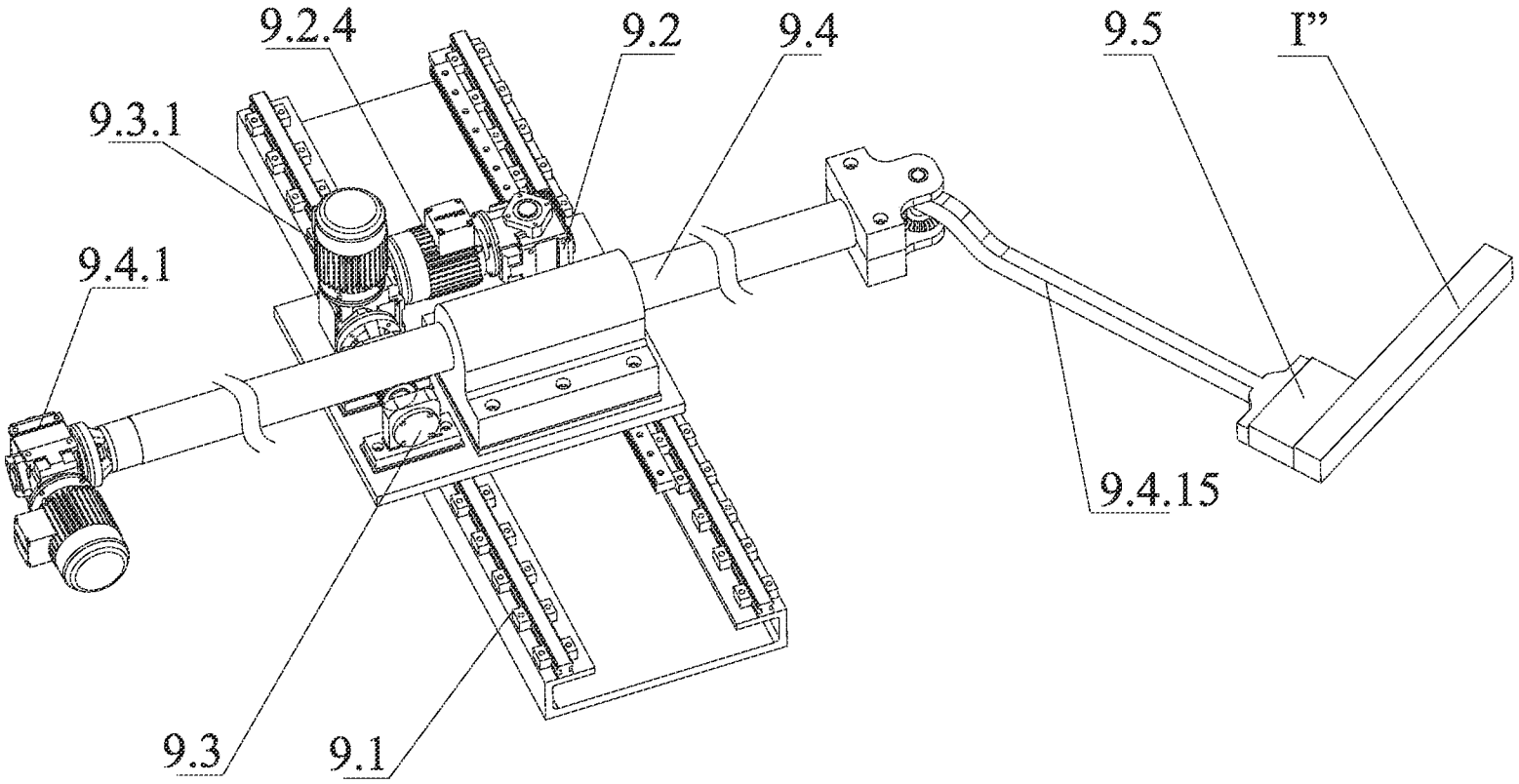
FIG. 6 is a schematic diagram of a third robot or a fourth robot according to one embodiment of the disclosure.
Figure 7:
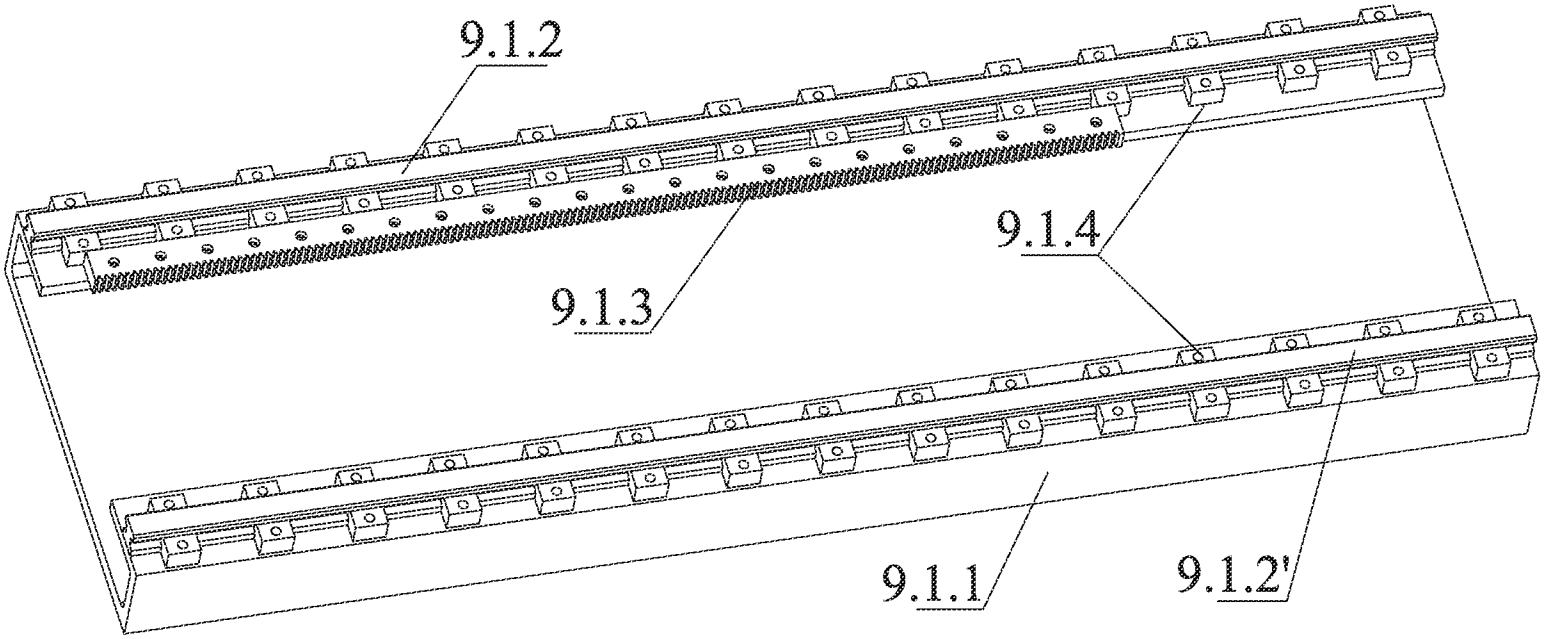
FIG. 7 is a three-dimensional drawing of a base assembly, namely the A-A
Figure 8A:
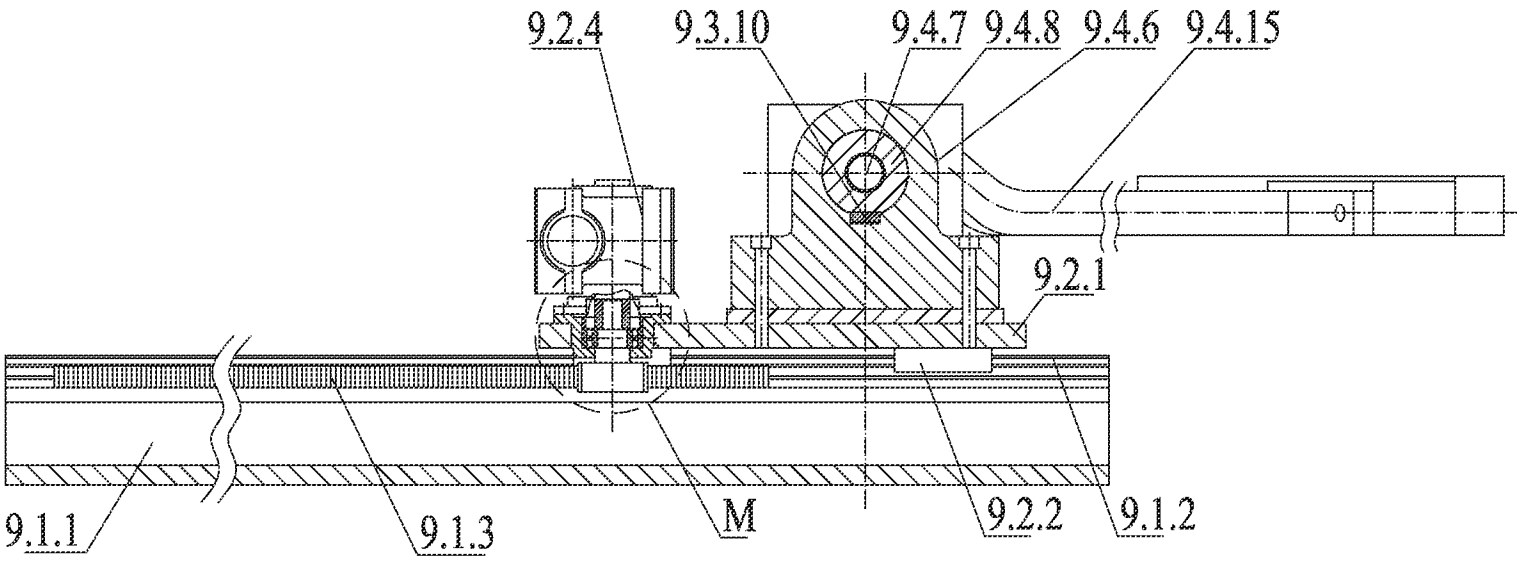
FIG. 8A is a schematic diagram of a traverse device according to one embodiment of the disclosure, namely the A-A sectional view in FIG. 5.
Figure 8B:
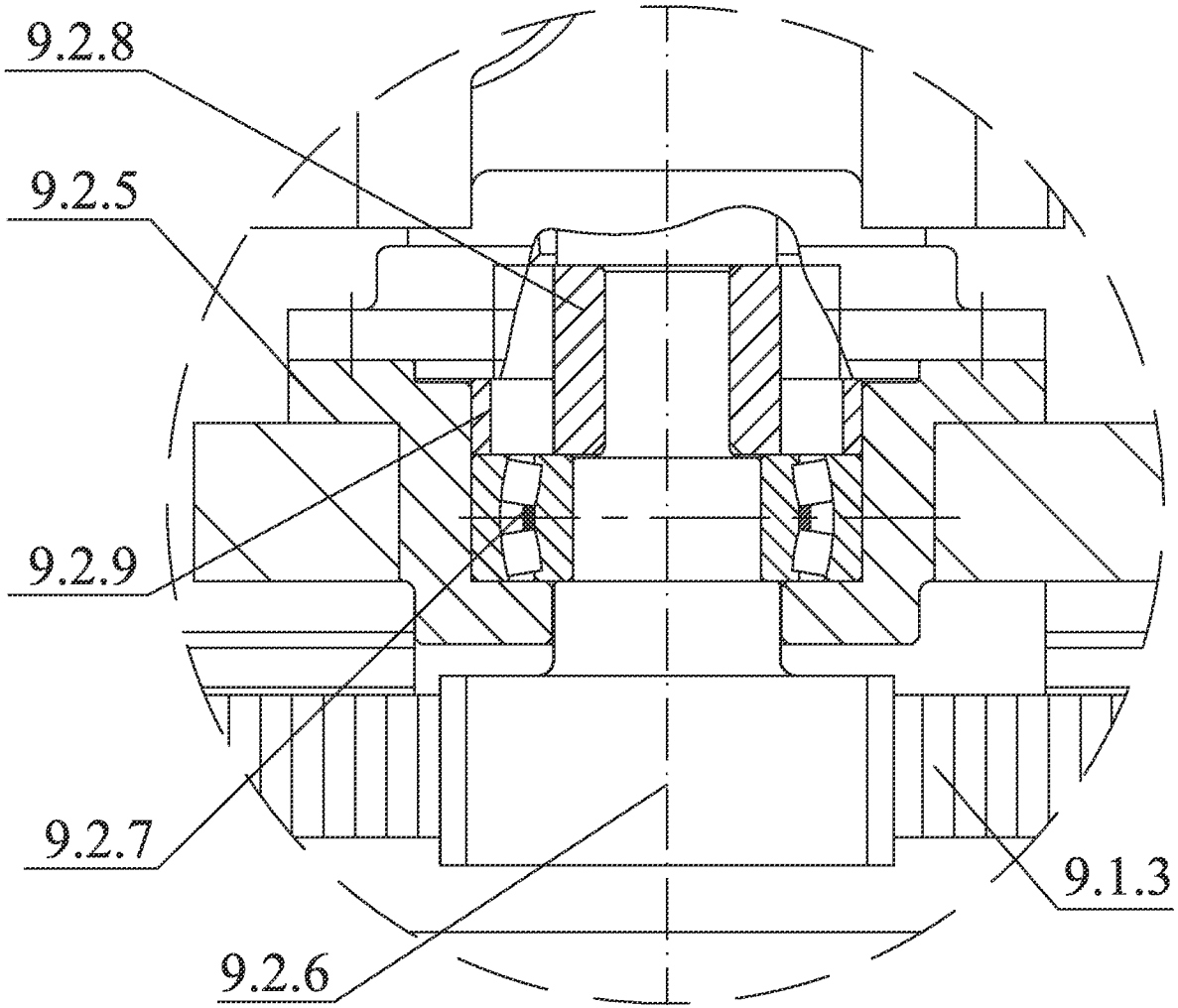
FIG. 8B is a local enlarged view of part M in FIG. 8A.
Figure 9:
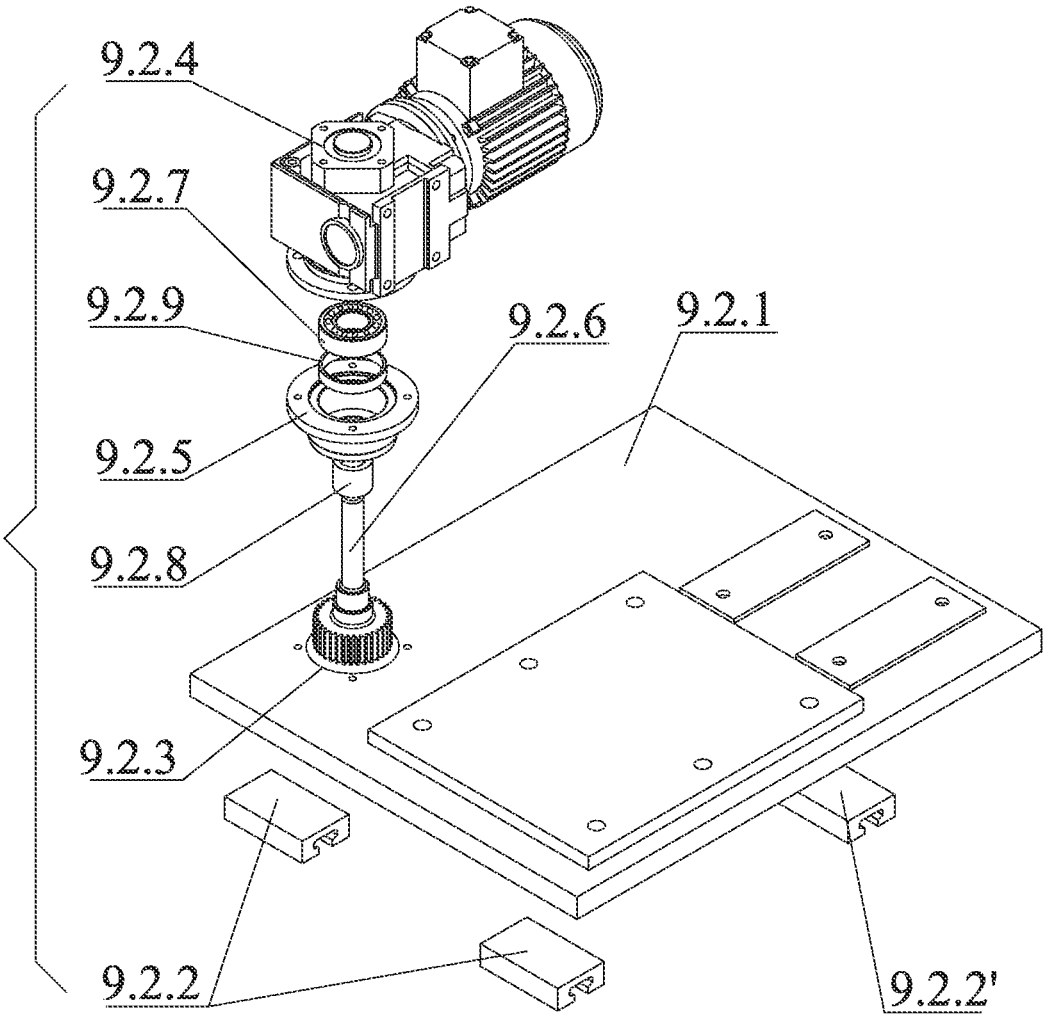
FIG. 9 is an exploded view of the traverse device according to one embodiment of the disclosure.
Figure 10A:
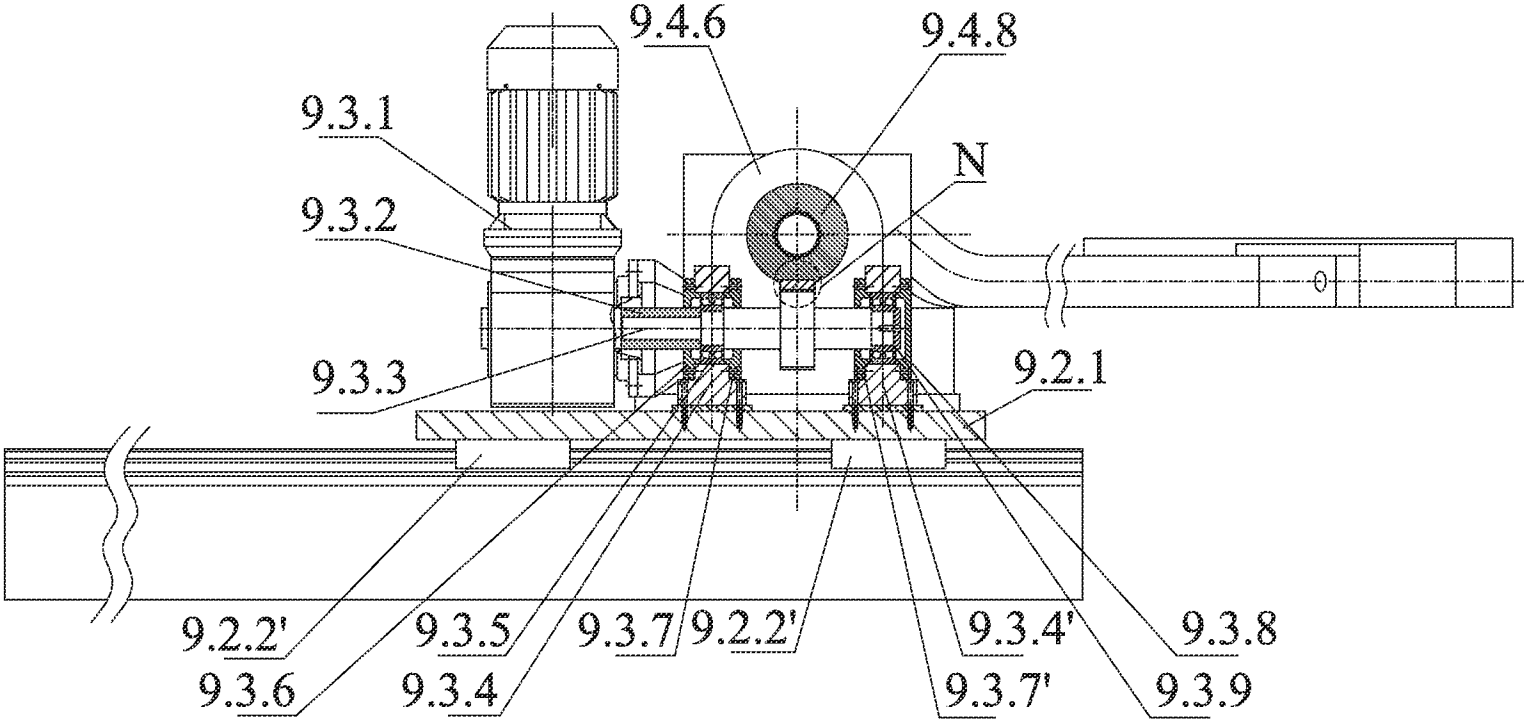
FIG. 10A is a schematic diagram of a pushing device according to one embodiment of the disclosure; namely the B-B sectional view in FIG. 5.
Figure 10B:
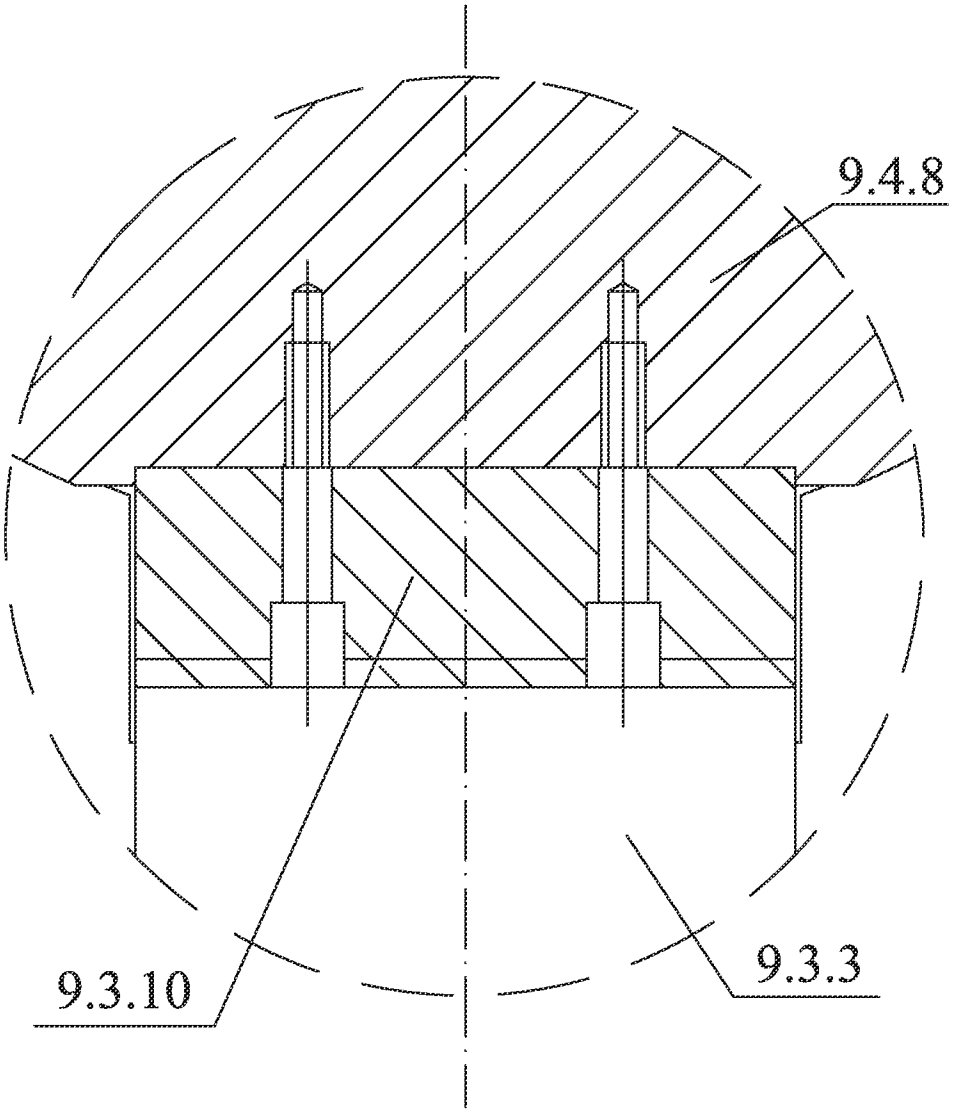
FIG. 10B is a local enlarged view of part N in FIG. 10A.
Figure 11:
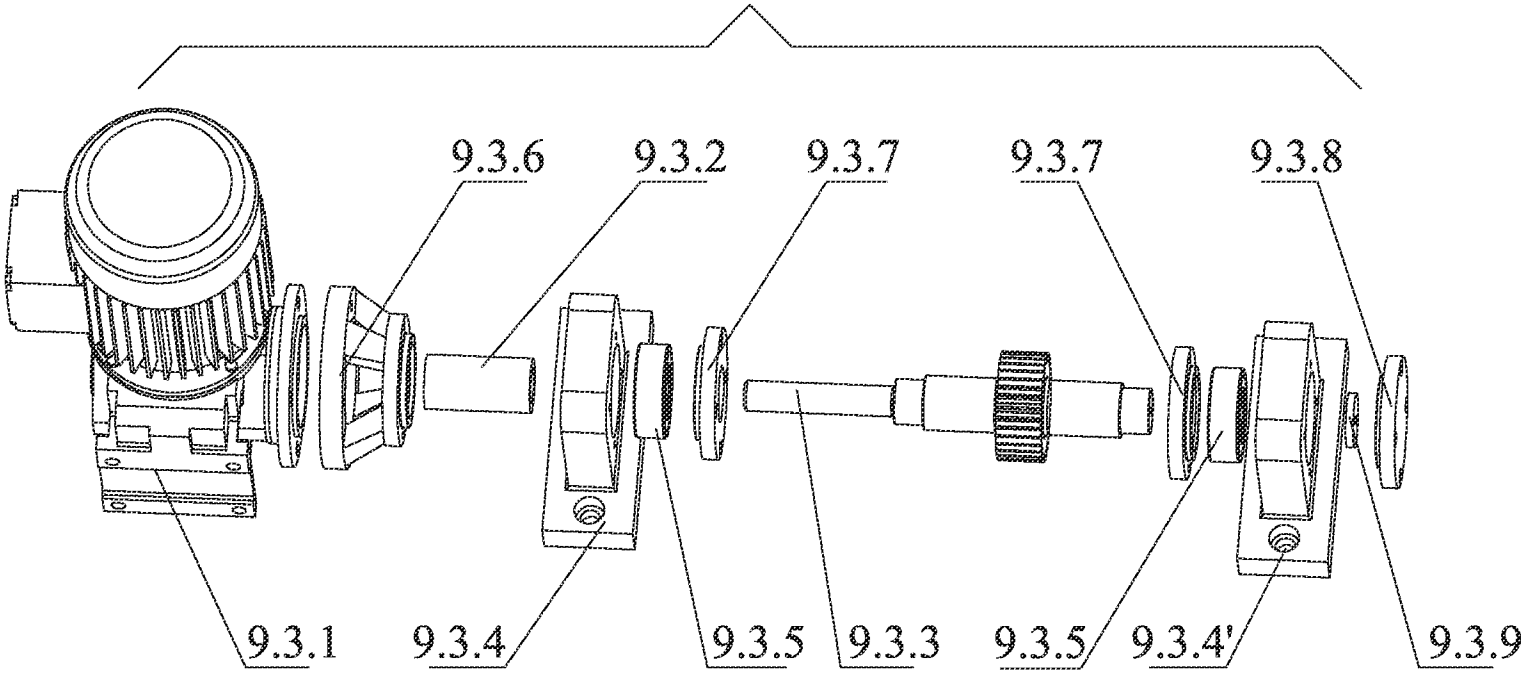
FIG. 11 is an exploded view of a pushing device according to one embodiment of the disclosure.
Figure 12:
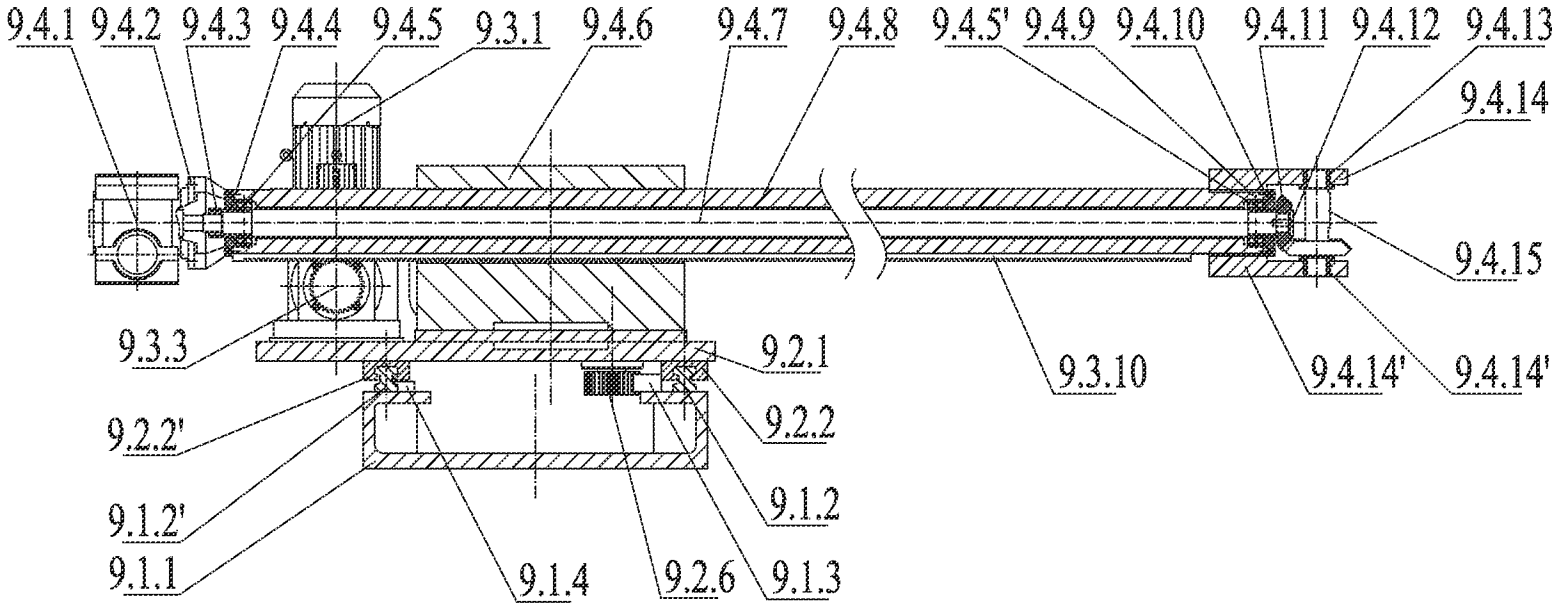
FIG. 12 is a cross-sectional view of a swing device according to one embodiment of the disclosure, namely the C-C sectional view in FIG. 5.
Figure 13:
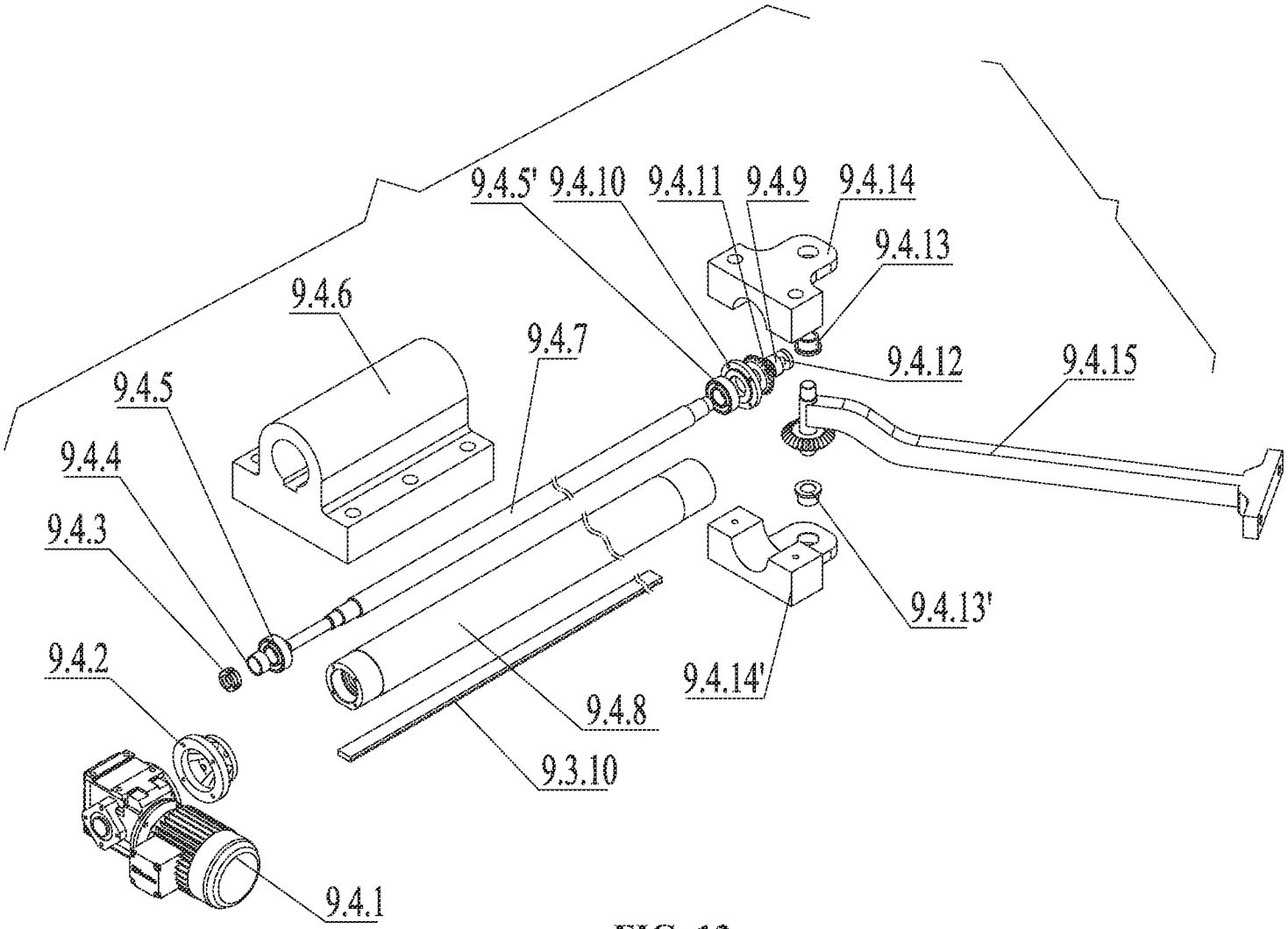
FIG. 13 is an exploded view of a swing device according to one embodiment of the disclosure.

Referring to FIG. 5, the third robot 9' and the fourth robot 9" are disposed on both sides of the flattening table 7.1. The flattening table 7.1 comprises a first column 7.4.1, a second column 7.4.2, a third column 7.4.1', and a fourth column 7.4.2'. A swing device 9.4 is disposed among the four columns 7.4.1, 7.4.2, 7.4.1', and 7.4.2'. The swing device 9.4, the electromagnet 9.5, and the second backing plate I" can be retracted to the space among the four columns 7.4.1, 7.4.2, 7.4.1', and 7.4.2'.

The electromagnet 9.5 is magnetic in the energized state, and non-magnetic in the de-energized state.

A first gear motor 9.2.4 drives the gear shaft 9.2.6 to rotate, interlocking the teeth of the first gear motor 9.2.4 with that of the gear rack 9.1.3. The first base 9.2.1 and the second base 9.2.5 drive the first sliding block 9.2.2 and the second sliding block 9.2.2' to move along the first guide rail 9.1.2 and the second guide rail 9.1.2', thereby moving laterally the pushing device 9.3, the swing device 9.4, the electromagnet 9.5, and the second backing plate I".

The pushing device 9.3 can be used to adjust the position of the second backing plate I". The second gear motor 9.3.1 drives the shaft 9.3.3 to rotate, interlocking the teeth of the shaft 9.3.3 and the pushing rack 9.3.10. The swing device 9.4, excluding the third base 9.4.6 thereof, moves along the axis of the rotating shaft 9.4.7, thereby driving the second backing plate I" to move.

The swing device 9.4 can be used to adjust the position of the second backing plate I". The third gear motor 9.4.1 drives the rotating shaft 9.4.7 to rotate, thereby driving the bevel gear 9.4.11 to rotate. The bevel gear 9.4.11 interlocks with the teeth of the bevel gear of the swing arm 9.4.15 so that the swing arm 9.4.15 rotates around the axis of a first spacer 9.4.14 and a second spacer 9.4.14', thereby adjusting the position of the second backing plate I".

The angle and position of the second backing plate I" are controlled by adjusting the traverse device 9.2, the pushing device 9.3, and the swing device 9.4. When the electromagnet 9.5 is powered off, the third robot 9' and the fourth robot 9" are retracted to the space among the four columns 7.4.1, 7.4.2, 7.4.1', and 7.4.2'.

The electromagnet 9.5 can be moved to the position of the second backing plate I" by adjusting the traverse device 9.2, the pushing device 9.3, and the swing device 9.4. The electromagnet 9.5 is energized, and then the second backing plate I" is retracted to the space among the four columns 7.4.1, 7.4.2, 7.4.1', and 7.4.2'.

It will be obvious to those skilled in the art that changes and modifications may be made, and therefore, the aim in the appended claims is to cover all such changes and modifications.

What is claimed is:

1. A system, comprising:

a crane;

a first conveyor;

a second conveyor;

a first shape detector;

a second shape detector;

a first rangefinder;

a second rangefinder;

a first detection device;

a second detection device;

a first idler roller;

a second idler roller;

a flattening machine;

a first robot;

a second robot;

a third robot; and a fourth robot;

wherein:

the flattening machine is connected to one end of the first conveyor and one end of the second conveyor;

the first shape detector is disposed above a middle part of the first conveyor; the second shape detector is disposed above a middle part of the second conveyor;

the first rangefinder is disposed at one end of the first conveyor; the first detection device is disposed between the first rangefinder and the flattening machine; the second rangefinder is disposed on one end of the flattening machine; the second detection device is disposed between the second rangefinder and the flattening machine;

the flattening machine comprises an inlet, an outlet, a flattening table, and a rack enclosure; the first idler roller is on the inlet and the second idler roller is on the outlet;

the first robot is disposed on the inlet and the second robot is disposed on the outlet; the third robot is disposed on a first end of the flattening table and the fourth robot is disposed on a second end of the flattening table;

the first robot and the second robot are configured to place or retract a first backing plate; the third robot and the fourth robot are configured to place or retract a second backing plate; and the crane is disposed above the first conveyor and the second conveyor.

2. The system of claim 1, wherein:

the third robot and the fourth robot each comprises a base assembly, a traverse device, a pushing device, a swing device, and an electromagnet;

the base assembly comprises a base plate comprising two protrusions, a first guide rail, a second guide rail, a plurality of rail clips, and a gear rack comprising teeth; the first guide rail and the second guide rail are respectively disposed on the two protrusions, and are secured and supported by the plurality of rail clips; the gear rack is disposed adjacent and parallel to the first guide rail or the second guide rail;

the traverse device comprises a first base, a first sliding block, a second sliding block, a first gear motor, a second base, a gear shaft, a bearing, a spacer ring, and a first shaft sleeve; the first base comprises a top side and a bottom side; the first sliding block and the second sliding block are disposed on the bottom side of the first base; the first base further comprises a mounting hole extending from the top side to the bottom side; the first gear motor is connected to the second base; the second base is connected to the gear shaft and disposed in the mounting hole; the bearing and the spacer ring are disposed on the gear shaft; the gear shaft is configured to be inserted into the mounting hole and interlocks with the teeth of the gear rack; the first shaft sleeve is disposed in the second base;

the pushing device comprises a second gear motor, a second shaft sleeve, a shaft, a first bearing seat, a second bearing seat, a first pushing bearing, a second pushing bearing, a first through cover, a second through cover, a third through cover, an end cover, a baffle and a pushing rack; the shaft is connected to the first bearing seat and the second bearing seat and then is disposed on the first base; the shaft is connected to the first pushing bearing and the second pushing bearing and then is disposed on the first bearing seat and the second bearing seat; one end of the shaft is connected to the second gear motor and another end of the shaft is connected to the baffle, the pushing rack interlocks with the gear in the middle part of the shaft; the second gear motor and the first pushing bearing are respectively connected to both ends of the second shaft sleeve; the first bearing seat and the second bearing seat are respectively disposed on the first base; and the swing device comprises a third gear motor, a nut, a third shaft sleeve, a first swing bearing, a second swing bearing, a third base, a rotating shaft, a fourth shaft sleeve, a fifth shaft sleeve, a fourth through cover, a bevel gear, a bearing baffle, a third base, a fourth base, a first spacer, a second spacer, and a swing arm; the rotating shaft is inserted into the second swing sleeve; one end of the rotating shaft is sequentially inserted into the first swing bearing, the third shaft sleeve, the nut, and the third gear motor; another end of the rotating shaft is sequentially inserted into the second swing bearing, the fourth through cover, the fifth shaft sleeve, the bevel gear, and the bearing baffle; the bearing baffle drives the swing arm to rotate; the third base and the fourth base are disposed on the outer surface of the second swing sleeve; the first spacer is disposed on the third base; the second spacer is disposed on the fourth base; the second swing sleeve is disposed in a hole of the third base; the pushing rack is disposed under the second swing sleeve; one end of the swing arm is disposed in the first spacer and the second spacer; the bevel gear of the swing arm interlocks with that of the bevel gear; another end of the swing arm is provided with the electromagnet.

* * * * *